US012209760B2

(12) United States Patent
Hartsell

(10) Patent No.: US 12,209,760 B2
(45) Date of Patent: Jan. 28, 2025

(54) METHOD AND APPARATUS FOR CONTROLLING DEW POINT IN AN INTERIOR SPACE

(71) Applicant: Alive Wellness and Fitness Group, LLC, Addison, TX (US)

(72) Inventor: Brandon Hartsell, Dallas, TX (US)

(73) Assignee: Alive Wellness and Fitness Group, LLC, Addison, TX (US)

( * ) Notice: Subject to any disclaimer, the term of this patent is extended or adjusted under 35 U.S.C. 154(b) by 198 days.

(21) Appl. No.: 17/896,594

(22) Filed: Aug. 26, 2022

(65) Prior Publication Data

US 2023/0062519 A1 Mar. 2, 2023

Related U.S. Application Data

(60) Provisional application No. 63/238,260, filed on Aug. 30, 2021.

(51) Int. Cl.
*F24F 11/00* (2018.01)
*F24F 11/80* (2018.01)
*F24F 110/10* (2018.01)
*F24F 110/20* (2018.01)

(52) U.S. Cl.
CPC ..... *F24F 11/0008* (2013.01); *F24F 11/80* (2018.01); *F24F 2110/10* (2018.01); *F24F 2110/20* (2018.01)

(58) Field of Classification Search
CPC .... F24F 11/0008; F24F 11/80; F24F 2110/10; F24F 2110/20; F24F 11/64
See application file for complete search history.

(56) References Cited

FOREIGN PATENT DOCUMENTS

CN 111076316 A * 4/2020 ..... F24F 11/62

* cited by examiner

*Primary Examiner* — Kun Kai Ma
(74) *Attorney, Agent, or Firm* — Norton Rose Fulbright US LLP

(57) ABSTRACT

A climate control system is configured to modulate the air environment of an interior space to maintain the dew point of the interior space within a predetermined operating dew point band as the temperature in the room fluctuates.

19 Claims, 5 Drawing Sheets

METHOD AND APPARATUS FOR CONTROLLING DEW POINT IN AN INTERIOR SPACE

CROSS-REFERENCE TO RELATED PATENT APPLICATIONS

This application claims the benefit of priority of U.S. Provisional Patent Application No. 63/238,260 filed on Aug. 30, 2021 and titled "METHOD AND APPARATUS FOR CONTROLLING DEW POINT IN AN INTERIOR SPACE," the disclosures of which are incorporated herein by reference in their entirety.

BACKGROUND

Conventional climate control systems include proportional-integral-derivative (PID) controllers that manage either or both of room temperature and humidity in a controlled interior space. For instance, when the room temperature is to be controlled at a desired predetermined temperature setpoint, the controller calls for hot air when the measured room temperature has fallen below the predetermined temperature setpoint by a predetermined amount. The controller no longer calls for heat when the measured room temperature reaches the predetermined temperature setpoint or some level near the predetermined temperature setpoint. Thus, the controller maintains the interior space within a desired range that includes the temperature setpoint. When the controller is programmed to further control humidity at a desired predetermined humidity setpoint, the controller calls for the introduction of water droplets into the interior space when the measured humidity falls below the predetermined humidity setpoint by a predetermined amount. The controller no longer calls for the introduction of water droplets when the measured humidity reaches the predetermined humidity setpoint or some level near the predetermined humidity setpoint. Thus, the climate control systems maintain the temperature of the room near the temperature setpoint, and maintain the humidity of the room near the humidity setpoint.

In some environments, such as fitness studios, it is desirable to maintain the dew point of the interior space to maintain a consistent environment suitable for exercise. The dew point is dependent upon both temperature and humidity. As one example, a dew point of 82.3 degrees Fahrenheit (F) can be achieved at 1) a temperature of 95.6 F and a relative humidity of 65.8%, 2) a temperature of 98.6 F and a relative humidity of 60%, and a temperature of 101.6 degrees and a relative humidity of 54.8%.

When the interior space exists in a high temperature environment, hot air can be introduced into the interior space via numerous modes of heat transfer. For instance, hot ambient air is introduced into the space by convection as the door is opened and closed. Heat can also be transferred into the interior space through the roof, walls, and windows of the interior space.

As a result, the room temperature in the interior space can exceed the predetermined temperature setpoint. When this occurs, the PID controller will of course not call for heat. However, when the room temperature increases and the relative humidity in the interior space remains substantially constant around the predetermined humidity setpoint, the dew point in the interior space can increase substantially. One way of preventing the dew point increase resulting from the increase in room temperature is to remove heat from the interior space. However, air cooling systems are expensive and consume large amounts of energy.

SUMMARY

There exists a need for an improved system that maintains an interior space at a substantially constant dew point at different room temperatures in the interior space. In one aspect of the present disclosure, a method is provided for controlling an environment of an interior space. The method can include the step of identifying an operating dew point band defined by a minimum dew point level and a maximum dew point level. The method can further include the step of determining whether an actual dew point in the interior space is less than the minimum dew point level. The method can further include the step of determining whether the actual dew point in the interior space is greater than the maximum dew point level. The method can further include the step of measuring an actual relative humidity in the interior space. The method can further include the step of adding humidity to the interior space in response to a determination that the actual dew point is less than the maximum dew point level and at least one of the actual dew point and the actual relative humidity in the interior space is not rising.

Any of the features or variations described above can be applied to any particular aspect or embodiment of the present disclosure in a number of different combinations. The absence of explicit recitation of any particular combination is due solely to the avoidance of repetition in this summary.

DETAILED DESCRIPTION

Certain exemplary embodiments will now be described to provide an overall understanding of the principles of the structure, function, manufacture, and use of the devices, systems, and methods disclosed herein. One or more examples of these embodiments are illustrated in the accompanying drawings. Those skilled in the art will understand that the devices, systems, and methods specifically described herein and illustrated in the accompanying drawings are non-limiting exemplary embodiments. The features illustrated or described in connection with one exemplary embodiment may be combined with the features of other embodiments. Such modifications and variations are intended to be included within the scope of the present disclosure.

Further, while various methods are described in connection with associated steps that are performed, it should be appreciated that certain steps can be omitted or repeated. Further, though the steps can be performed in a different order than that described, as appreciated by one having ordinary skill in the art. As used herein, the singular forms "a," "an," and "the" associated with apparatus and method steps include "at least one" and a plurality. Further, reference to a plurality associated with apparatus and method steps include the includes the singular "a," "an," "one," and "the," and further includes "at least one."

The present disclosure recognizes that it can be desirable to balance the room temperature and relative humidity to achieve a desirable dew point of the interior space. As one example, during exercise, the human body exerts itself and recovers through perspiration. However, an excessive room temperature and relative humidity can lead to a suboptimal environment for recovery. In one specific example, such as hot yoga, the room is maintained at high temperatures. When the humidity level in the room is controlled to maintain a desired dew point, the person exercising can enjoy a strenuous but rewarding experience. As will now be described, methods and apparatus are provided that maintain the dew point substantially constant even during periods of wide temperature fluctuation in an interior space.

Figure 1:
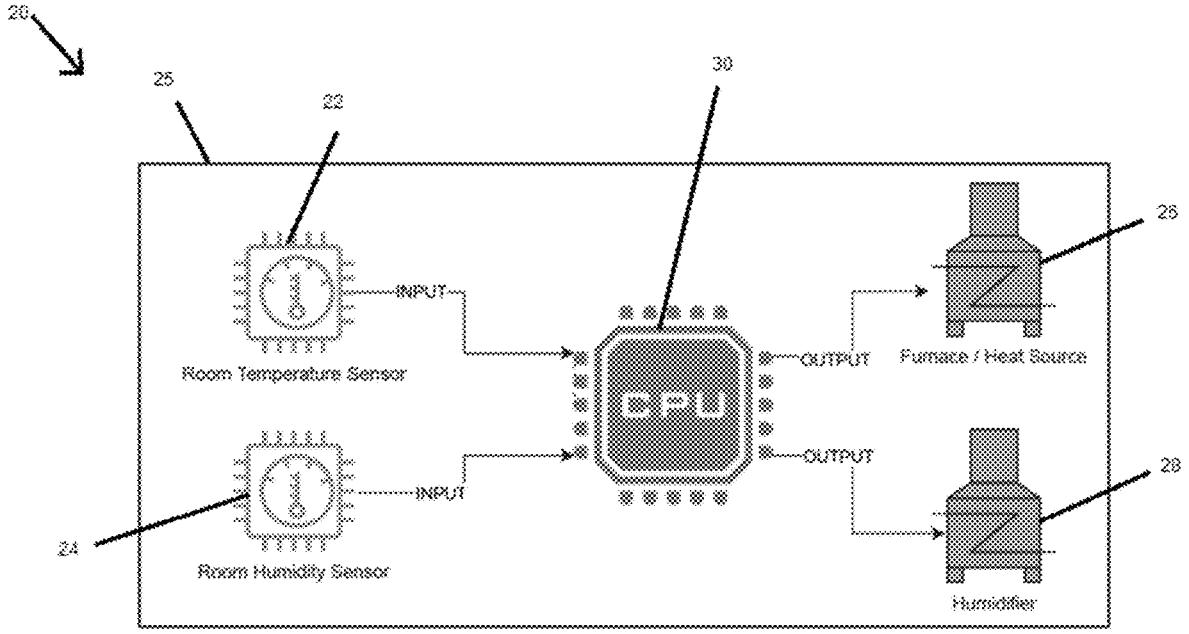
FIG. 1 is a schematic diagram of a climate control system constructed in accordance with one example.

Referring initially to FIG. 1, a climate control system 20 includes at least one room temperature sensor 22 such as a thermometer that measures the room temperature of an interior space 25, and at least one room humidity sensor 24 that measures the relative humidity of the interior space 25. The climate control system 20 further includes at least one heat source 26, such as a furnace that is configured to be activated to deliver heat to the air of the interior space 25 so as to increase the room temperature. The climate control system 20 further includes at least one humidifier 28 that is configured to be activated to introduce moisture into the interior space 25 during a humidifying sequence 45 (see FIG. 3) so as to increase the relative humidity of the interior space 25.

The climate control system 20 can further include a controller 30 that can receive inputs from the room temperature sensor 22 and the humidity sensor 24 and calculate the dew point. Controller 30 can be in wired or wireless communication with one or more other components of system 20, such as sensors 22, 24, external sources (e.g., 26, 28), or other electrical component typically utilized during a climate control processes. Controller 30 may include a processor coupled to a memory (e.g., a computer-readable storage device). In some configurations, controller 30 may include one or more application(s) that access processor and/or memory to perform one or more operations of system 20, as described herein. Processor may include or correspond to a microcontroller/microprocessor, a central processing unit (CPU), a field-programmable gate array (FPGA) device, an application-specific integrated circuits (ASIC), another hardware device, a firmware device, or any combination thereof. Memory, such as a non-transitory computer-readable storage medium, may include volatile memory devices (e.g., random access memory (RAM) devices), nonvolatile memory devices (e.g., read only memory (ROM) devices, programmable read-only memory, and flash memory), or both. Memory may be configured to store instructions, one or more thresholds, one or more data sets, or combination thereof. In some configurations, instructions (e.g., control logic) may be configured to, when executed by the one or more processors, cause the processor (s) to perform one or more operations (e.g., determining temperatures, humidifies, dew points, or the like, transmitting signal or alerts based on measured parameters, actuating a hear or humidity source, or the like). The one or more thresholds and one or more data sets may be configured to cause the processor(s) to generate control signals to perform the operations. As described herein, system 20 can include real-time monitoring of interior space 25 and be configured to maintain the interior space in a target dew point range.

The controller 30 can be disposed in the interior space 25 that is being controlled, or can be disposed outside the interior space 25. As will be appreciated from the description below, however, the controller 30 can receive any two values of the three inputs of room temperature, relative humidity in the interior space 25, and dew point of the interior space, and calculate the value third of the three inputs. The controller 30 can activate the heat source 26 based on an input associated with a temperature increase step to increase the actual room temperature of the interior space 25. Additionally, or alternatively, controller 30 can activate the humidifier 28 based on an input associated with a humidifying step to increase the relative humidity of the interior space 25. For instance, the humidifier 28 can deliver humidity in the form of water droplets or the like into the interior space 25. As will now be described, the climate control system 20 can advantageously maintain the dew point of the interior space 25 within a predetermined range by modulating the humidifier 28 as the room temperature fluctuates.

In some examples, the control system 20 does not include a heat remover that decreases the temperature of the interior space 25. Further, in some examples, the control system 20 does not include a dehumidifier that removes moisture from the air of the interior space. Advantageously, even without a heat remover and dehumidifier, the climate control system 20 can be configured to maintain an actual dew point in the interior space 25 within a desired operating dew point band. It should be appreciated, however, that other configurations of climate control system 20 can include either or both of a heat remover and dehumidifier.

One method 40 of controlling the environment or air of the interior space will be described with reference to FIGS. 1-3. The method 40 can include a system control process 42 that can be configured to determine whether conditions of the interior space 25 dictate that humidity is to be added. The method 40 can further include a system configuration check 43, if desired, that determines whether conditions of the control system 20 are sufficient to add humidity. The steps associated with the method 40 can be performed by the climate control system 20, and in particular the controller 30. In one example, the method 40 is stored in volatile or non-volatile memory of the controller 30. In some examples, the controller 30 executes a stored program to perform the method 40.

As will be appreciated from the description below, the controller 30 can be configured to perform steps associated with method 40 to maintain the actual dew point of the interior space within an operating dew point band by controlling the humidity of the controlled interior space 25 based on the measured actual temperature of the interior space. That is, as either or both of the temperature and relative humidity falls in the interior space, the climate control system 20 can add humidity to the interior space to maintain the dew point in the operating dew point band. As the temperature rises to a level whereby the dew point is in the operating band, the control system can stop introducing moisture into the interior space 25 to maintain the actual dew point of the interior space 25 within the operating dew point band.

Figure 2:
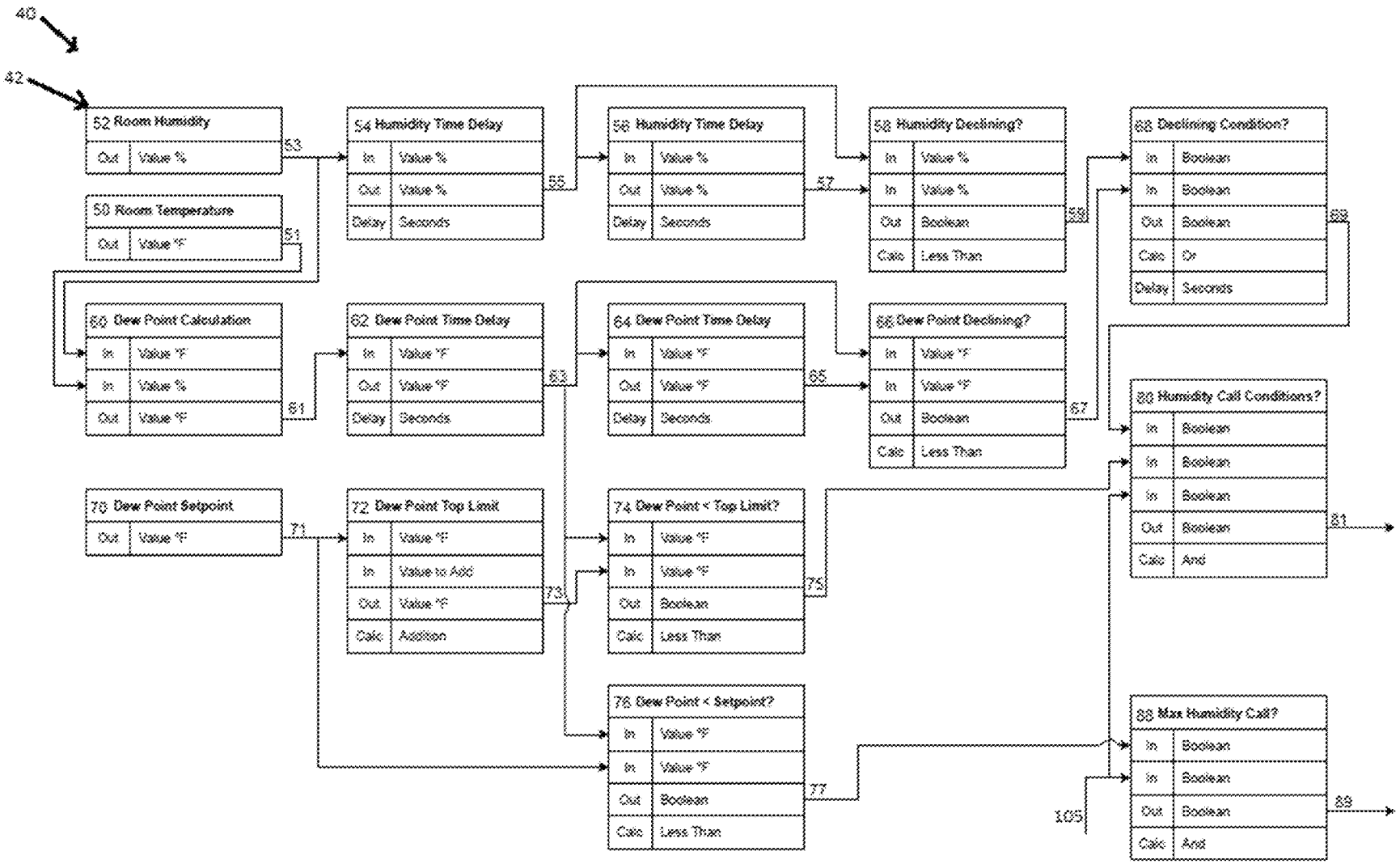
FIG. 2 is a flow chart that illustrates steps associated with a system control process of a method of controlling the environment of an interior space.

Referring now to FIGS. 1-2, the system control process 42 includes a decision block 80 (shown in FIG. 2) that determines if humidity call conditions are satisfied to generate a humidity call. If so, an output 81 of the decision block 80 can indicate to a humidity call decision block 82 (shown in FIG. 3) that a humidifying sequence is to be performed. As described in more detail below, the humidity call conditions can be met when either or both of the relative humidity and the dew point of the interior space 25 are not rising (e.g., maintaining or declining) as determined at decision blocks 58 and 66, respectively. In this regard, it should be appreciated that descriptions of declining conditions as described herein, including relative humidity and dew point, can equally apply to conditions that are not rising, which can include declining conditions or conditions that are maintaining at a constant level.

In response to the output 81, the humidity call decision block 82 can generate an output 83 that causes humidity to be to be introduced into the interior space in the form of water droplets or any other form as desired. As shown at steps 84, 86, and 92, the humidity can be introduced at a first stage of humidity, a second stage of humidity, or a third stage of humidity. In some examples the third stage can be the final stage. In some configurations, at the first stage 84, humidity is added to the interior space at a first rate, at the second stage 86, humidity is added at a second rate that is greater than the first rate, and at step 92, humidity is added at a third rate that is greater than the second rate. In some examples, the third rate can be a maximum rate at which humidity may be introduced into the interior space 25 by the control system 20. In one potential mode of operation, the system can initially add humidity into the interior space 25 at the first stage, and subsequently add humidity into the interior space 25 at the second stage 1) in response to a determination that (i) either or both of the actual dew point and the actual relative humidity has been declining over a predetermined duration, and (ii) either or both of the actual dew point and the actual relative humidity is continuing to fall, and 2) when the actual dew point is not above the operating dew point band, and in particular when the actual dew point is not greater than a lower threshold of the operating dew point band.

In some configurations, system control process 42 can begin at steps 50 and 52 whereby the actual temperature and relative humidity of the interior space 25, respectively, are measured. An actual temperature output 51 can generated from the room temperature sensor 22 and transmitted to the controller 30 that indicates the actual temperature of the interior space as measured at step 50. An actual relative humidity output 53 can be generated from the humidity sensor 24 and transmitted to the controller 30 that indicates the actual relative humidity measured at step 52. Both outputs 51 and 53 are received at step 60, which calculates actual dew point in the interior space 25 based on the measured actual temperature and relative humidity, and provides an output 61 of the actual dew point. It is appreciated that the climate control system 20 can measure any two of the following: actual temperature, relative humidity, and dew point, and can calculate the third variable (actual temperature, relative humidity, or dew point) based on the two measured variables, such as that shown at step 60.

The system control process 42 can then determine whether the actual relative humidity in the interior space is declining at decision block 58. This can be accomplished in more than one way. In one example, the controller 30 receives the actual relative humidity output 53 from step 52, and determines the actual relative humidity of the interior space 25 at step 54 at a first humidity determination frequency. As an example, the actual relative humidity can be sampled at the first humidity determination frequency. Alternatively, the actual relative humidity can be measured or otherwise calculated at the first humidity determination frequency. The first humidity determination frequency can be defined by a first humidity measuring time delay, such that the actual relative humidity is repeatedly determined on an ongoing basis upon successive expirations of the first humidity measuring time delay. The first humidity measuring time delay can be manually entered, or programmed into the controller 30. The controller can provide successive outputs 55 from step 54 that indicate the actual relative humidity at the first humidity determination frequency to the decision block 58.

In some configurations, the outputs 55 can be provided to step 56 whereby the controller 30 determines the actual relative humidity at a second humidity determination frequency that is different from (e.g., less than) the first humidity determination frequency. Alternatively, the controller 30 can receive the output 53 generated at step 52 to determine the actual relative humidity at the second humidity determination frequency at step 56. In one example, the actual relative humidity can be sampled at the second humidity determination frequency. Alternatively, the actual relative humidity can be measured or otherwise calculated at the second humidity determination frequency. The second humidity determination frequency can be defined by a second humidity measuring time delay that is greater than the first humidity measuring time delay. In one illustrative, non-limiting example, the first humidity measuring time delay can be in a range of 2 to 10 seconds (e.g., 5 seconds) and the second humidity measuring time delay can be in a range of 15 to 60 seconds (e.g., 30 seconds). In some examples, the second humidity measuring time delay can be a multiple of the first humidity measuring time delay. Thus, the actual relative humidity is repeatedly determined on an ongoing basis upon successive expirations of the second humidity measuring time delay. The second humidity measuring time delay can be manually entered, or programmed into the controller 30. The controller can provide successive outputs 57 of the actual relative humidity at the second humidity determination frequency from step 56 to the decision block 58.

At decision block 58, the controller 30 can determine whether the actual relative humidity is declining over a predetermined duration of time, which can be defined by the second humidity determination frequency. In one example, the controller 30 compares the relative humidity as determined at the first humidity determination frequency to the relative humidity as determined at the second humidity determination frequency. To illustrate, when the actual relative humidity determined at the first humidity determination frequency is determined to be less than the actual relative humidity determined at the second humidity determination frequency, the controller 30 determines that the actual relative humidity is declining at decision block 58. When the controller 30 determines that the actual relative humidity is declining, the controller 30 can set an output 59 from decision block 58 to a TRUE state, which indicates that the actual relative humidity is declining. In some configurations, when the relative humidity as determined at the first humidity determination frequency is equal to or greater than the relative humidity as determined at the second humidity determination frequency, the controller 30 does not determine that the actual relative humidity is declining, and thus the controller can set the output 59 to a FALSE state. It should be appreciated that while the output 59 is set to the TRUE state when it is determined that the actual relative humidity is declining, the output 59 can alternatively be in the TRUE state when it is determined that the relative humidity is not increasing. The output 59 is sent to a decision block 68 that determines whether a declining condition exists in the interior space.

With continuing reference to FIGS. 1-2, the system control process 42 can further determine whether the dew point in the interior space 25 is declining at decision block 66. This can be accomplished in more than one way. In one example, the output 61 of the actual dew point is received from step 60, and the controller 30 can determine the actual dew point of the interior space 25 at step 62 at a first dew point determination frequency. For instance, the actual dew point can be sampled at the first dew point determination frequency. Alternatively, the actual dew point can be measured or otherwise calculated at the first dew point determination frequency. The first dew point determination frequency can be defined by a first dew point time delay, such that the actual dew point is repeatedly determined on an ongoing basis upon successive expirations of the first dew point time delay. The first dew point time delay can be manually entered, or programmed into the controller 30. The first dew point time delay, and the first dew point determination frequency, can be equal to, greater than, or less than the first relative humidity time delay and the first relative humidity frequency, respectively.

In some configurations, controller 30 can provide successive outputs 63 of the actual dew point at the first dew point determination frequency to the decision block 66 at step 62. At step 62, the outputs 63 are also provided to step 64 whereby the controller 30 determines the actual dew point at a second dew point determination frequency that is less than the first dew point determination frequency. The outputs 63 of 62 can also be provided to a decision block 76 that can determine whether the actual dew point is below a dew point setpoint, as described in more detail below. Step 62 can further provide the outputs 63 to step 64 that determines the actual dew point at a second dew point determination frequency that is less than the first dew point determination frequency.

Alternatively, the controller 30 can receive the output 61 generated at step 60 to determine the actual dew point at the second dew point determination frequency at step 64. In one example, the actual dew point can be sampled at the second dew point determination frequency. Alternatively, the actual dew point can be measured or otherwise calculated at the second dew point determination frequency. The second dew point determination frequency can be defined by a second dew point time delay that is different from (e.g., greater than) the first dew point time delay. In one illustrative, non-limiting example, the first dew point time delay can be in a range of 2 to 10 seconds (e.g., 5 seconds) and the second dew point time delay can be in a range of 15 to 60 seconds (e.g., 30 seconds). In some examples, the second dew point time delay can be a multiple of the first dew point time delay. Thus, the actual dew point is repeatedly determined on an ongoing basis upon successive expirations of the second time delay. The second dew point time delay can be manually entered, or programmed into the controller 30. At step 64, the controller can provide successive outputs 65 of the actual dew point at the second dew point determination frequency to the decision block 66.

At decision block 66, the controller 30 can determine whether the actual dew point is declining over a predetermined duration of time, which can be defined by the second dew point determination frequency. In particular, the controller 30 can compare the dew point as determined at the first dew point determination frequency to the dew point as determined at the second dew point determination frequency. To illustrate, when the actual dew point determined at the first dew point determination frequency is determined to be less than the actual dew point determined at the second dew point determination frequency, the controller 30 determines that the actual dew point is declining at decision block 66. In some configurations, when the controller 30 determines that the actual dew point is declining, the controller 30 sets an output 67 from decision block 66 to a TRUE state, indicating that the actual dew point is declining. In other configurations, when the dew point as determined at the first dew point determination frequency is equal to or greater than the dew point as determined at the second dew point determination frequency, controller 30 does not determine that the actual dew point is declining, and the controller 30 sets the output 67 to a FALSE state. It should be appreciated that while the output 67 can be set to TRUE generated when it is determined that the actual dew point is declining, the output 67 can alternatively be set to TRUE it is determined that the dew point is not increasing. The output 67 can be sent to the decision block 68 that determines whether a declining condition exists in the interior space.

As described above, the decision block 68 can receive both the output 59 indicating whether the actual relative humidity in the interior space is declining, and output 67 indicating whether the actual dew point in the interior space is declining. When either of the outputs 59 and 67 is in a TRUE state, the decision block 68 may determine that the interior space 25 is experiencing a declining condition. Alternatively, the controller 30 can be configured to determine that the interior space has the declining condition when both of the outputs 59 and 67 are in the TRUE state.

In some configurations, controller 30 generates an output 69 at the decision block 68 in response to the determination of whether the declining condition exists in the interior space. The output 69 can be received by the decision block 80. The declining condition can be defined by either or both of the actual dew point and the actual relative humidity in the interior space. When the declining condition exists, the controller sets the output 69 to a TRUE state, which may be received by the decision block 80 and indicates to the decision block 80 that a declining condition exists as defined by either or both of the dew point and the relative humidity in the interior space 25. If it is determined at decision block 68 that a declining condition does not exist, then the controller can set the output 69 to a FALSE state, which may be received at decision block 80. As described above, the decision block 80 determines whether humidity call conditions are satisfied to initiate a humidifying sequence 45 (see FIG. 3) of the method 40 whereby humidity is introduced into the interior space 25. In some configurations, decision block 80 requires all received outputs to be true in order to determine that humidity call conditions are satisfied. In such configurations, the controller 30 will determine that humidity call conditions are not satisfied when the output 69 is in the FALSE state.

With continuing reference to FIGS. 1-2, the system control process 42 can determine the operating dew point band. In one example, as shown in FIG. 2, the operating dew point band is identified, having a minimum dew point level which can be defined by setpoint, and a maximum dew point level that can be defined by a top limit. In one example, the setpoint is determined at step 70. The setpoint can be determined and input into the system locally by the user, can be programmed into the controller 30, or can be input into the system from a remote location that controls a plurality of interior spaces in the manner described herein. Alternatively, the setpoint can be calculated based on a user input of a desired minimum temperature and a desired minimum humidity.

In some configurations, controller 30 generates a setpoint output 71 at step 70 that identifies the setpoint. The set point output 71 can be received at step 72, whereby the controller 30 determines the top limit of the operating dew point band. In some configurations, the controller 30 adds a value to the set point to determine the top limit. The value can thus represent the size, or range, of the dew point band. The value can be determined and input by the user, or can be programmed into the controller 30. The value can be determined and input into the system locally by the user, can be programmed into the controller 30, or can be input into the system from a remote location that controls a plurality of interior spaces in the manner described herein. Alternatively still, the setpoint and the top limit can be directly input or can be calculated based on a minimum temperature and relative humidity and a maximum temperature and relative humidity, respectively.

As will now be described with continuing reference to FIGS. 1-2, the system can be further configured to add humidity to the interior space when the actual dew point is within the operating dew point band. In an example, when a first state exists whereby the system detects that the dew point in the interior space is below the operating dew point band, the system initiates a humidifying sequence 45 to introduce humidity into the interior space. Additionally, or alternatively, the system can detect a second state where the actual dew point is in the operating dew point band, and either or both of the actual dew point and relative humidity in the room is decreasing as determined at decision block 68, and the system can initiate the humidifying sequence 45. The first and second states will now be described in more detail.

In some configurations, the setpoint output 71 that is generated at step 70 is received at the decision block 76, which determines whether the actual dew point is not greater than, and for instance is below, the setpoint. In one example, the decision block 76 also receives the output 63 of step 62 to determine the actual dew point in the interior space. The controller 30 can generate an output 77 at decision block 76 that indicates whether a condition is satisfied at decision block 76 that the actual dew point as determined at step 62 is not greater than, and for instance is less than, the setpoint. If the condition is satisfied at decision block 76, the controller can set the output 77 to a TRUE state that is received at decision block 88. In response to the output 77 in the TRUE state, the controller can call for humidity to be introduced into the interior space 25 at decision block 88. Whether the output 77 is set to the TRUE state when it is determined that the actual dew point is not greater than the setpoint or is below the setpoint, it can nevertheless be said that the output is in the TRUE state when it is determined that the actual dew point is below the minimum dew point level that can be defined by the setpoint.

In some configurations, controller 30 generates an output 89 at decision block 88 that indicates whether a call for humidity is needed based on the actual dew point being below the minimum dew point level. In some examples, the decision block 88 can also receive an output 105 (described below) from the system configuration check 43 (shown in FIG. 4) that verifies that the system is properly configured to deliver humidity prior to generating the output 89. Alternatively, the output 105 from the system configuration check 43 can be sent instead to the humidifying sequence 45 (shown in FIG. 3). In some configurations, when the output 105 is received by the decision block 88, and both the output 87 and the output 105 are in a TRUE state, the controller 30 sets the output 89 to a TRUE state at the decision block 88. The output 89 can be received at a decision block 82 (see FIG. 3) that is configured to activate the humidifier 28, as will be described in more detail below. The output 89 can instruct the decision block 82 to activate the humidifier to deliver the first stage of humidity, the second stage of humidity, or the third stage of humidity as desired. Alternatively, the decision block 82 can initiate the humidifying sequence 45 at the greatest stage of humidity that the system is configured to apply as determined at the system configuration check 43. It is appreciated that the introduction of humidity into the interior space will increase both the relative humidity and the dew point in the interior space 25. When the actual dew point in the interior space 25 increases to a level greater than or in some instances equal to (i.e., no less than) the setpoint, the controller sets the output 89 to a FALSE state, thereby removing the call for humidity. It should be appreciated that the output 89 can be set to the FALSE state when the actual dew point in the interior space 25 reaches a level greater than the set point, for instance up to the maximum dew point level, and the output 89 can remain TRUE until the actual dew point increases from a level below the setpoint to the level greater than the set point, if desired.

In an illustrative example, controller 30 is configured to cause the humidifier 28 to introduce humidity into the interior space 25 solely in response to a determination that the interior space 25 is in a first condition whereby the actual dew point in the interior space 25 is below a predetermined minimum dew point level. The controller 30 can further be configured to cause the humidifier to introduce humidity into the interior space 25 in response to a determination that the interior space 25 is in a second condition whereby the actual dew point in the interior space is below the maximum dew point level, so long as the system determines that either or both of the relative humidity and the actual dew point in the interior space 25 is declining. The actual dew point is below the minimum dew point level during the first interior space condition. However, the actual dew point can be above the minimum dew point level when the interior space 25 is in the second condition. Thus, the actual dew point can be in the operating dew point band when the interior space 25 is in the second condition. It can be appreciated that the controller 30 causing the humidifier 28 to introduce humidity into the interior space when the interior space is in each of the first and second conditions can also be subject to a determination that the climate control system 20 is properly configured to introduce humidity.

The second condition of the interior space 25 will now be further described with reference to FIGS. 1-2. To illustrate, as described above, step 72 can receive the setpoint output 71 that was generated at step 70, and the controller 30 can determine the top limit of the operating dew point band at step 72. In some configurations, the top limit is generated as a top limit output 73 from step 72, and can define a maximum dew point level of the operating dew point band. The top limit output 73 can be sent to a decision block 74 that also receives the dew point output 63 that was determined at step 62. At the decision block 74, the controller 30 may compare the actual dew point determined at step 62 to the top limit output 73. Based on the comparison, the controller 30 can determine whether a condition at decision block 74 is satisfied that the actual dew point is less than, or no greater than, the top limit.

The decision block 74 may generate an output 75 that indicates whether the condition is satisfied at decision block 74 and is received at the decision block 80. If the condition at decision block 74 is satisfied, the controller 30 can set the output 75 to a TRUE state which can be received at the decision block 80 to indicate that the actual dew point in the interior space 25 is in the operating dew point band or is not greater than a maximum dew point level. If the condition at decision block 74 is not satisfied, meaning that the actual dew point in the interior space 25 is above the operating dew point band, the controller 30 can set the output 75 to a FALSE state which is received at the decision block 80. Thus, when the actual dew point is lower than, or not greater than, the predetermined limit, the output 75 can be set to the TRUE state indicating a call for humidity when the interior space 25 is in a declining condition as determined at decision block 68.

As described above, the system control process 42 includes the decision block 80 that determines when to initiate a call for humidity when the interior space 25 is in the second condition, as described above. In some configurations, the decision block 80 receives the output 69 that indicates whether the interior space is in a declining condition as defined by decision block 68. The decision block 80 may further receive the output 75 that indicates whether the dew point is less than the top limit. When the outputs 69 and 75 are each in the TRUE state, the controller 30 determines that conditions have been met to call for humidity at the decision block 80. Accordingly, the controller 30 sets an output 81 from the decision block 80 to a TRUE state. Alternatively, if one of the outputs 69 and 75 is in a FALSE state, then the controller determines that the conditions are not satisfied to initiate a humidity call at the decision block 80, and the output 81 is set to a FALSE state. The output 81 can be received by the humidifying sequence 45. It should be appreciated that, the decision block 80 can receive an output 105 from the system configuration check 43 that the control system is properly configured to deliver the humidity in response to the call for humidity from decision block 80. Alternatively, the output 105 from the system configuration check 43 can be sent instead to the humidifying sequence 45.

In some configurations, the controller 30 therefore determines at the decision block 80 whether the conditions in the interior space dictate the control system to add humidity into the interior space even when the dew point is greater than the minimum drew point level. As an example, when all outputs are received at decision block 80 are in their respective TRUE states, the controller 30 will initiate the humidifying sequence that adds humidity to the interior space. In some such configurations, if any one of the inputs to decision block 80 is not received at the decision block 80, then the controller 30 will not initiate the humidifying sequence.

It should therefore be appreciated that the control system can be configured to add humidity to the interior space in response to a determination in response to either or both of a determination that 1) the actual dew point is less than the minimum dew point level as determined at decision block 88, and 2) the actual dew point is less than the maximum dew point level and at least one of the actual dew point and the actual relative humidity in the interior space is not rising as determined at decision block 80.

Referring now to FIG. 2, the humidifying sequence 45 can begin at decision block 82, where the controller 30 determines whether a humidity call has been initiated. As described above, the humidity call can be initiated at either or both of the decision block 80 and the decision block 88, as shown in FIG. 1. If either or both of the humidity calls have been initiated as indicated by outputs 81 and 89 being set to their respective TRUE states, the controller 30 determines at the decision block to activate the at least one humidifier 28 to deliver humidity to the interior space 25. When either of the outputs 81 and 89 is in their TRUE state, the controller can set an output 83 from the decision block 82 to a TRUE state. When the output 83 is in the TRUE state, the controller 30 may activate the humidifier 28 to deliver humidity in the form of water droplets or the like into the interior space 25. As described above, the output 105 that can be sent to the decision blocks 80 and 88, respectively, can instead be sent to the decision block 88. The controller 30 can thus not set the output 83 to the TRUE state until the output 105 is set to its TRUE states. If both of the outputs 81 and 89 are in their respective FALSE states, the controller 30 does not activate the humidifier 28, or discontinues the humidifier 28 as warranted.

As described above, the humidity can be delivered from the humidifier 28 to the interior space 25 in multiple stages. For example, as shown in FIG. 3, in response to the output 83 being in the TRUE state, the controller 30 can determine whether to deliver the humidity into the interior space 25 at the first stage 84, the second stage 86, or the third stage 90. In a specific non-limiting example, the system 20 can transition from the first stage to the second stage if 1) the actual relative humidity or dew point in the interior space continues to fall, and 2) the actual relative humidity remains in the operating dew point band. In some configurations, system 20 can transition to the third stage if the dew point falls to a level less than the setpoint. It can be determined whether the climate control system 20 is configured to deliver humidity into the interior space 25 at the third the third stage. For example, a decision block 90 can receive the output 83 from the decision block 82, and further receives outputs 125 and 127 from the configuration check 43 (shown in FIG. 4). If the outputs 125 and 127 are in their respective TRUE states, then the controller 30 may set an output 91 from the decision block 90 to a TRUE state. The output 91 is applied to step 92 that receives the output 91, and initiates the delivery of the third stage of humidity into the interior space 25 when the output 91 is in its TRUE state. If either or both of the outputs 125 and 127 is in a FALSE state, the controller 30 can set the output 91 to a FALSE state which is received at the step 92. In response, the step 92 does not initiate the delivery of the third stage of humidity. In some configurations, the system 20 can maintain the second stage of humidity until either 1) the condition that triggered the humidity call is removed, at which point the humidifying sequence will end or 2) the outputs 125 and 127 become TRUE, in which case stage three of humidity will be called.

Figure 3:
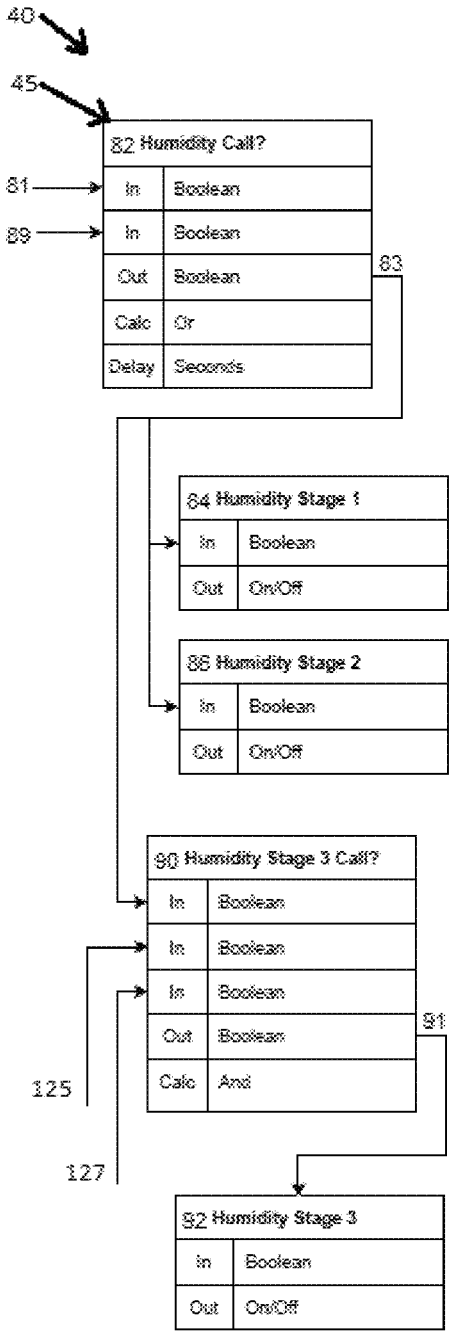
FIG. 3 is a flow chart that illustrates steps associated with a humidifying sequence of the method of controlling the environment of the interior space.

With continuing reference to FIG. 3, the controller 30 can further be configured such that a call for humidity from decision block on output 83 is intended to activate all three humidity stage calls at steps 84, 86, and 90. The activation of the third stage of humidity can be subject to either or both of the outputs 125 and 127 being TRUE in the manner described herein. As illustrated in FIG. 3, the first and second stages of humidity can be activated by a call for humidity without checking the status of the supply line and the water line. In some examples, either or both of the second stage of humidity can be subject to either or both of the outputs 125 and 127 being TRUE. In other examples, the user can manually initiate only the first stage of humidity as desired, or the first stage of humidity can be initiated as described above.

As described above, the controller 30 can initiate the humidifying sequence 45 upon either or both of outputs 81 and 89 in their TRUE state. In some examples, the controller 30 can undergo a time delay prior to setting the humidity call output 83 to TRUE. Thus, either or both of the outputs 81 and 89 must be in their ongoing and uninterrupted TRUE states for at least a portion of, such as an entirety of, the time delay before the output 83 can be set to its TRUE state. The output 83 can be in the FALSE state during the time delay. The time delay can improve the chance that the condition causing the humidity call is an ongoing condition. As described herein, the time delay can reduce the likelihood of actuating the humidifier 28 for a short period of time, such as when the condition that calls for humidity is transitory in nature. The time delay can be any length of time, and in some configurations can be in a range from 15 seconds to 60 seconds. While the time delay can be applied to the output 83 as described above, the time delay can alternatively or additionally apply to either or both of the outputs 59 and 67 when in their respective TRUE states that identify a declining condition in the interior space 25.

The system configuration check 43 will now be described with reference now to FIG. 4. The system configuration check 43 includes a decision block 104 that determines whether humidity requirements are met by the control system 20 such that it is determined that the conditions of the control system 20 are suitable for actuation of the humidifier 28 to introduce humidity into the interior space 25. In an example, as described above, when it is determined that the conditions of the control system 20 are suitable for actuation of the humidifier 28, then the system configuration check 43 (e.g., output 105) does not prevent the humidity call decision blocks 80 and 88 from generating their respective outputs 81 and 89 in their respective TRUE states.

The decision block 104 has an output 10. In some configurations, decision block 104 can receive a plurality of inputs. In one example, the controller 30 sets the output 105 to a TRUE state when all of the inputs received by the decision block 104 are in their respective TRUE states. In such configurations, if any of the inputs to the decision block 104 is in a FALSE state, then the controller 30 will set the output 105 to a FALSE state. Therefore, the respective outputs 81 and 89 of the decision blocks 80 and 88 will be set to their FALSE states, and the humidifying sequence 45 will not be initiated. The inputs to the decision block 104 will now be described, it being appreciated that in certain examples any one of (up to and including all of) the inputs described can be received at the decision block 104. In still other examples the control system 20 does not perform the system configuration check 43.

Figure 4:
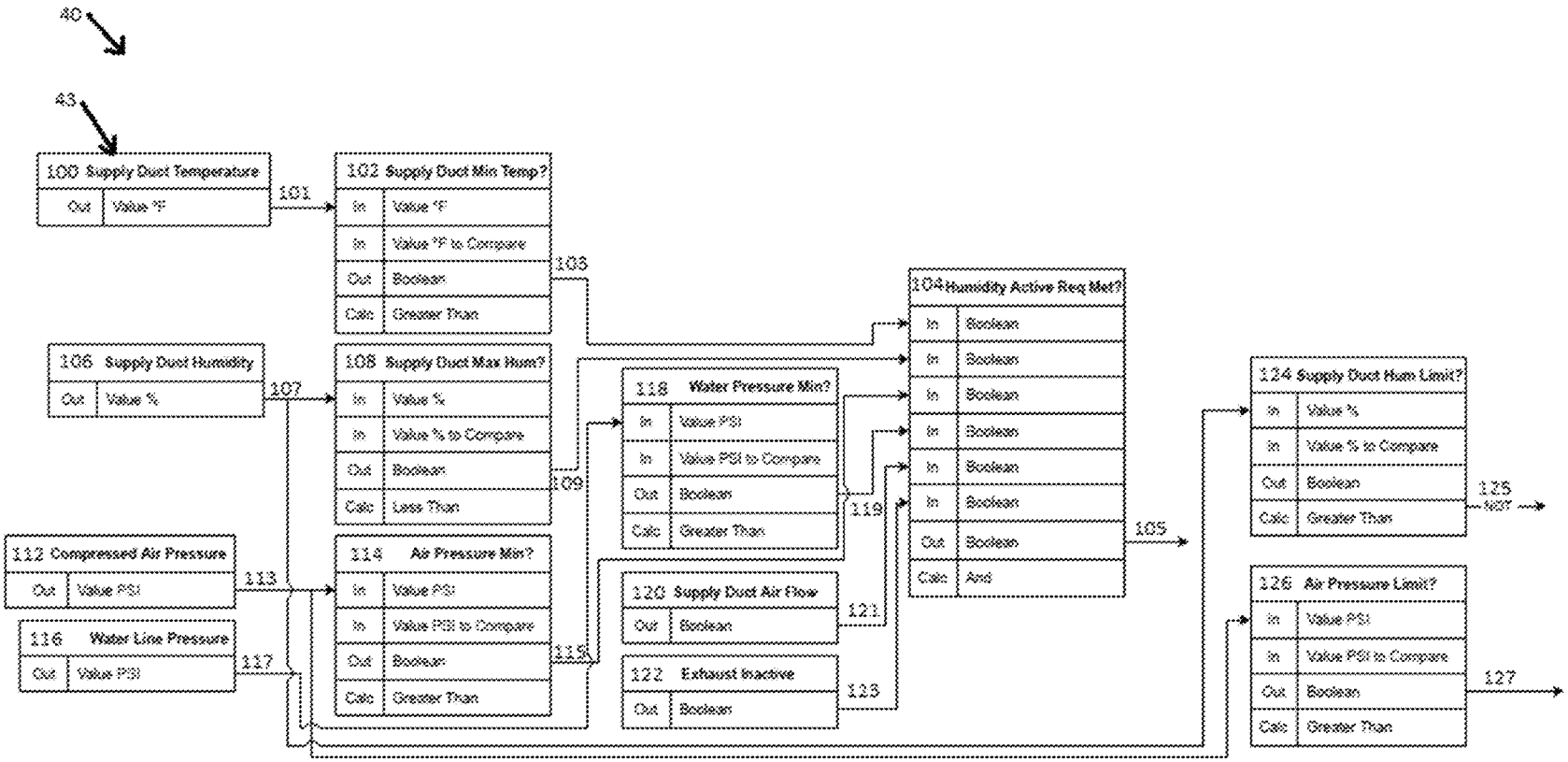
FIG. 4 is a flow chart that illustrates steps associated with a system configuration check of the method for controlling the environment of the interior space.

Referring now to FIG. 4, at decision block 100 the temperature can be measured in the supply duct that feeds the humidifier 28, and the temperature is output as a supply duct temperature output 101 that is sent to a decision block 102. At decision block 102, the controller can compare the supply duct temperature to a minimum temperature value. The minimum temperature value can be input manually, or can be programmed into the controller 30, or can be set from a remote location that controls a plurality of control systems 20. In some configurations, if the supply duct temperature is greater than the minimum temperature value, then the controller 30 can set an output 103 of decision block 102 to a TRUE state. The output 103 can be sent to the decision block 104. If the supply duct temperature is not greater than the minimum temperature value, then the controller 30 sets the output 103 to FALSE. When the output 103 is FALSE, the control system 20 may not initiate the humidify sequence 45. When the output 103 is TRUE, control system 20 can determine that the temperature in the supply duct is sufficient for the introduction of humidity in the interior space 25 in the manner described above. In some configurations, based on output 103 being false, the control system 20 can actuate one or more components, such as furnace (e.g., 26), to increase the temperature of air in the supply duct.

At decision block 106, the humidity level in the supply duct is measured, and the humidity level can be output as a supply duct humidity output 107 that is sent to a decision block 108. At decision block 108, the controller can compare the humidity level in the supply duct to a maximum humidity value. The maximum humidity value can be input manually, or can be programmed into the controller 30, or can be set from a remote location that controls a plurality of control systems 20. If the humidity level in the supply duct is less than the maximum humidity value, then the controller 30 can set an output 109 of the decision block 108 to a TRUE state. The output 109 can be sent to the decision block 104. If the humidity level in the supply duct is not less than the maximum humidity value, then the controller 30 can set the output 109 to FALSE. When the output 109 is FALSE, the control system 20 may not initiate the humidify sequence 45. When the output 109 is TRUE, control system 20 can determine that the humidity level in the supply duct is sufficient for the introduction of humidity in the interior space 25 in the manner described above. In some configurations, based on output 109 being false, the control system 20 can actuate one or more components, such as humidifier 28, to increase the humidity level of air in the supply duct.

At decision block 112, the compressed air pressure in the air supply line that supplies air to the humidifier 28 is measured, and a compressed air pressure value can be output as a supply line air pressure output 113 that is sent to a decision block 114. At decision block 114, the controller 30 can compare the compressed air pressure in the supply line to a minimum air pressure value. The minimum air pressure value can be input manually, or can be programmed into the controller 30, or can be set from a remote location that controls a plurality of control systems 20. If the compressed air pressure value in the supply duct is greater than the minimum air pressure value, then the controller 30 can set an output 115 of the decision block 114 to a TRUE state. The output 115 can be sent to the decision block 104. If the compressed air pressure value in the supply duct is not greater than the minimum air pressure value, then the controller 30 can set the output 115 to FALSE. When the output 115 is FALSE, the control system 20 may not initiate the humidify sequence 45. When the output 115 is TRUE, it is concluded that the compressed air pressure value in the supply line is sufficient for the introduction of humidity in the interior space 25 in the manner described above. In some configurations, based on output 115 being false, the control system 20 can actuate one or more components, such as a pressure source, to increase the air pressure in the supply duct.

At decision block 116, the water line pressure in the water line that supplies the humidifier 28 is measured, and the water pressure can be output as a water pressure output 117 that is sent to a decision block 118. At decision block 118, the controller 30 can compare the water pressure in the water line to a minimum water pressure value. The minimum water pressure value can be input manually, or can be programmed into the controller 30, or can be set from a remote location that controls a plurality of control systems 20. If the water line pressure in the water line is greater than the minimum water pressure value, then the controller 30 can set an output 119 of the decision block 118 to a TRUE state. The output 119 can be sent to the decision block 104.

If the water line pressure in the water line is not greater than the minimum water line value, then the controller 30 can set the output 119 to FALSE. When the output 119 is FALSE, the control system 20 may not initiate the humidify sequence 45. When the output 119 is TRUE, it is concluded that the water line pressure value in the water line is sufficient for the introduction of humidity in the interior space 25 in the manner described above. In some configurations, based on output 119 being false, the control system 20 can actuate one or more components, such as a pressure source or water line, to increase the pressure in the water line.

At decision block 120, it can be verified that the airflow in the supply duct is active. In this regard, the control system 20 can include an airflow sensor in the air supply duct to the interior space 25. The airflow sensor detects whether air is flowing across the sensor in the duct, indicating that air is flowing through the duct. If the airflow is active in the supply duct, the controller 30 can set an output 121 of the step 120 to a TRUE state. The output 121 can be sent to the decision block 104. If the airflow is not active in the supply duct, then the controller 30 can set the output 121 to FALSE. When the output 121 is FALSE, the control system 20 may not initiate the humidify sequence 45. When the output 121 is TRUE, it is concluded that the airflow in the supply duct is sufficient for the introduction of humidity in the interior space 25 in the manner described above. In some configurations, based on output 121 being false, the control system 20 can actuate one or more components, such as a pressure source, to activate airflow in the supply duct.

At decision block 122, it can be verified that the exhaust is inactive. When the exhaust is active, it can pull fresh outdoor air and exhaust return air from the interior space. The system 20 thus can prevent the step of actuating the humidifier 28 when the exhaust is active, which can cause the humidified air the be output through the exhaust. Step 122 thus can reduce inefficiencies in the system 20. In some examples the exhaust can be disposed on the roof top of the building that defines the interior space 25. In some examples, the exhaust can be modulated separate from the method 40. If the exhaust is inactive, the controller 30 can set an output 123 of the step 122 to a TRUE state. The output 123 can be sent to the decision block 104. If the exhaust is active, in the supply duct, then the controller 30 can set the output 123 to FALSE. When the output 123 is FALSE, the control system 20 may not initiate the humidify sequence 45. When the output 123 is TRUE, it is concluded that the airflow in the supply duct is sufficient for the introduction of humidity in the interior space 25 in the manner described above. In some configurations, based on output 123 being false, the control system 20 can actuate one or more components, such as one or more vents, to deactivate the exhaust.

Therefore, the decision block 104 can receive any one or more of the outputs 103, 109, 115, 119, 121, and 123. If all of the outputs are in their respective TRUE states, then the controller 30 will set the output 105 to its TRUE state. When the output 105 received at the decision block is in its TRUE state, the system control process 42 may introduce humidity into the interior space in the manner described above when either or both of the following occur: 1) the actual dew point in the interior space is no greater than, for instance below, the setpoint, or 2) the actual dew point no greater than, for instance less than, the top limit, and at least one or both of the actual dew point and the relative humidity in the interior space is declining. If at least one of the outputs received at the decision block is in its FALSE state, then the controller 30 may set the output 105 to its FALSE state. When the output 105 is in its FALSE state, the system control process 42 will not introduce humidity into the interior space. In some examples, the system can provide an output to the user displaying the status of each of the outputs 103, 109, 115, 119, 121, and 123. Therefore, if any of the outputs 103, 109, 115, 119, 121, and 123 are FALSE, the user can easily identify the output and make modifications to the control system 20 as desired. In some configurations, control system 20 can actuate one or more components in an attempt to change any of the outputs 103, 109, 115, 119, 121, and 123 to TRUE.

Referring now to FIG. 3, the humidifying sequence 45 can further send either or both of outputs 125 and 127 to decision block 90, which as described above determines whether to cause the at least one humidifier 28 to introduce humidity into the interior space 25 at the third stage as described above. When the output 83 from the humidity call decision block 82 is TRUE, and both the outputs 125 and 127 are in their TRUE states, the third stage of humidity can be introduced into the interior space. If either of the outputs 15 and 127 is in a FALSE state, the third stage of humidity is either not initiated or discontinues the third stage of humidity.

In the configuration shown in FIG. 4, the output 125 can be generated by the controller 30 at decision block 124, which determines whether the humidity level in the supply duct is not greater than a humidity limit value. If the humidity level in the supply duct is not greater than the humidity limit value, then the controller may allow actuation of the third stage of humidification at step 90 (see FIG. 3). If the humidity level in the supply duct is greater than the humidity limit value, then the controller can prevent actuation of the third stage of humidification at step 90. During operation, the controller 30 can receive the relative humidity in the supply duct to the interior space at decision block 124 to determine that it is not greater than the humidity limit value. The humidity limit value of decision block 124 can be less than the maximum humidity value of the decision block 108. In some aspects, the decision at decision block 108 can determine whether the humidity level in the supply duct is too great for a humidity call at any stage of humidity, whereas the decision at decision block 124 determines whether the humidity level in the supply duct is too great for stage three humidity to be activated. Thus, in one example, either or both of the first and second stages of humidity can be activated even when the humidity in the supply duct is greater than the humidity limit value at decision block 124. At decision block 124, the controller 30 compares the humidity level in the supply duct to the humidity limit value. If the humidity level in the supply duct is not greater than the humidity limit value, then the controller 30 can set an output 125 of the decision block 124 to a TRUE state. The output 125 is sent to the decision block 90 as described above. If the humidity level in the supply duct is greater than the humidity limit value, the controller 30 sets the output 125 to FALSE.

The output 127 can be generated by the controller 30 at decision block 126, which determines whether the air-line pressure in the air supply line to the humidifier is not less than (e.g., greater than or equal to) the minimum air pressure limit. If the air-line pressure in the air supply line is greater than the minimum air pressure limit, then the controller does not prevent actuation of the third stage of humidification at step 90 (see FIG. 3). If the air pressure in the supply line is not greater than the minimum air pressure limit, then the controller 30 can prevent actuation of the third stage of humidification at step 90. During operation, the controller 30 receives the air pressure value in the air supply line to the humidifier 28 at decision block 124 to determine if it is greater than, or no less than, the minimum air pressure limit. The minimum air pressure limit of decision block 126 can be greater than the minimum air pressure value of decision block 114. In this regard, the decision at decision block 114 can determine whether the air pressure level in the supply is too low for a humidity call at any stage of humidity, whereas the decision at decision block 126 determines whether the air pressure level in the supply line is too low for stage three humidity to be activated. Thus, in one example, either or both of the first and second stages of humidity can be activated even when the air pressure value in the air supply line to the humidifier 28 is less than the minimum air pressure limit. At the decision block 126, the controller 30 compares the air pressure in the air supply line to the air pressure limit value. If the air pressure in the supply line is greater than, or not less than, the air minimum pressure limit value as determined at decision block 126, then the controller 30 can set the output 127 of the decision block 126 to a TRUE state. The output 127 can be sent to the decision block 90 as described above. If the air pressure in the supply line is not greater than, such as less than, the minimum air pressure limit value, the controller 30 sets the output 127 to FALSE.

Figure 5:
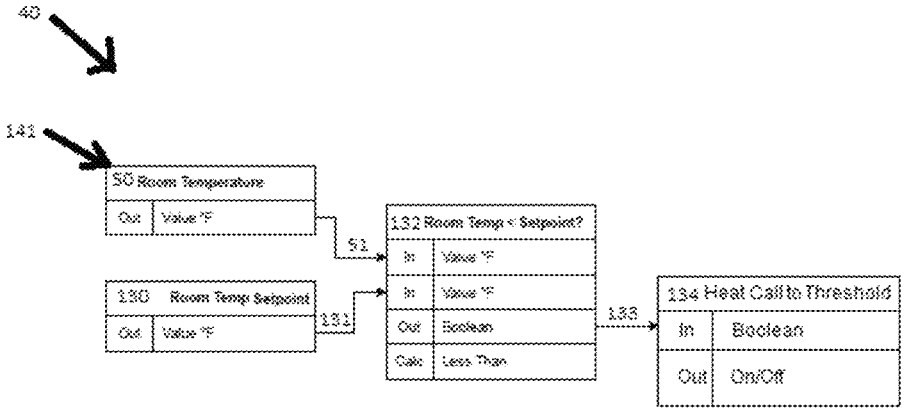
FIG. 5 is a flow chart that illustrates steps associated with a temperature control process of the method for controlling the environment of the interior space.

Referring now to FIGS. 1 and 5, it is recognized that the actual temperature in the interior space 25 can be maintained to be at or above a predetermined temperature value. It is appreciated that as the actual temperature rises, the dew point also rises assuming a constant relative humidity. Conversely, as the actual temperature falls, the dew point also falls assuming a constant relative humidity. The method 40 described above can maintain the dew point in the operating dew point band as described above, even as the temperature rises and falls. The predetermined temperature value can be dependent upon the purpose of the interior space. In one example, the interior space can be used a fitness studio. In one illustrative application, the fitness studio is configured for use as a hot yoga studio whereby the temperature in the interior space can be at least approximately 80 degrees Fahrenheit (F), such as at least approximately 85 degrees F. It should be appreciated, of course, that the present disclosure is not limited to examples whereby hot yoga is practiced in the interior space 25, and all activities in the interior space that can benefit from controlling the actual dew point in the manner described herein are contemplated.

Referring now to FIG. 5, method 40 can include a temperature control process 141 that maintains the actual temperature in the interior space 25 to at least at a predetermined minimum temperature level. In one example, the predetermined minimum temperature level can be selected as suitable for hot yoga activities in the interior space. In some such configurations, the predetermined minimum temperature level can be at least 80 degrees F., such as at least 90 degrees F., and in particular at least 92 degrees F. Thus, the predetermined minimum temperature can be in a range from 80 degrees F. to 100 degrees F., such as between 90 degrees F. to 95 degrees F. It is further recognized that the actual temperature can rise to levels up to and above 100 degrees, particularly when the interior space 25 is located in a geographical region having hot temperatures that increase the temperature of the interior space 25 through any one or more modes of heat transfer. In some circumstances, it is recognized that the actual temperature in the interior space 25 can fall, for instance if an exterior door or window is opened and cool ambient air is allowed to enter. If the temperature in the interior space 25 drops below the predetermined minimum temperature level, the temperature control process 141 can activate the at least one heat source 26 to add heat to the interior space 25.

In some configurations, the temperature control process 141 receives the actual temperature output 51 that is generated from the room temperature sensor 22 to the controller 30 that indicates the actual room temperature of the interior space 25 as measured during step 50, as described above. The temperature setpoint can be entered at step 130 that determines a minimum temperature level in the interior space 25. Step 130 generates a temperature setpoint output 131 that indicates the temperature setpoint. The temperature setpoint can be determined and input into the system locally by the user, can be programmed into the controller 30, or can be input into the system from a remote location that controls a plurality of interior spaces in the manner described herein. Alternatively, the temperature setpoint can be calculated based on a user input of a desired minimum humidity and a desired minimum dew point.

The temperature control process 141 can include a decision block 132 that receives both the actual temperature output 51 and the temperature setpoint output 131, and determines whether the actual temperature of the interior space 25 is not greater than, for instance less than, the temperature setpoint. If so, the controller 30 sets an output 133 from the decision block 132 to a TRUE state. If the actual temperature of the interior space is not less than, for instance greater than, the temperature setpoint, then the controller 30 sets the output 133 to a FALSE state. The temperature control process 141 includes a decision block 134, or heating step, that receives the output 133 from the decision block 132. When the output 133 is in the TRUE state, the controller 30 can actuate the at least one heat source 26 to deliver heat to the interior space 25. The heat can be delivered until the actual temperature in the interior space reaches the set point or reaches a predetermined value above the set point. When the output 133 is in the FALSE state, the heat source is not active. In response to the FALSE state of the output 133, the controller 30 either does not activate the heat source 26, or the controller 30 deactivates the heat source 26 if it was previously activated.

It should be appreciated that the actual temperature can be identified at first and second frequencies as described above with respect to the actual humidity and actual dewpoint, and apply an output as TRUE to the decision block 134 when it is determined that the actual temperature is in a declining condition. In some configurations, when the actual temperature is not in a declining condition, the output 133 can be set to FALSE.

The temperature control process 141 can further monitor the temperature of the supply duct to the interior space 25. It is recognized that the temperature of the interior space 25 can be influenced by the temperature of the supply duct. Thus, the temperature control process 141 can initiate a call for heat when the temperature of the supply duct falls below a minimum supply duct temperature level that is a predetermined amount below the temperature setpoint of the interior space. In some examples, the minimum supply duct temperature level can be a multiple of a difference between the temperature in the interior space and the temperature set point for the interior space. Thus, when the temperature in the supply duct falls to a level that is less than the multiple of the difference between the temperature in the interior space and the temperature set point for the interior space, a respective output set to TRUE can be received at decision block 133. When the temperature in the supply duct is not less than (or greater than) the minimum supply duct temperature level, the respective output can be set to FALSE.

It is appreciated that decision block 134 can call for heat if any one or more of the outputs received at decision block 134 are set to TRUE. The heat can be delivered in a single stage or in multiple stages. For instance, the heat can be delivered in two stages, including a first stage and a second stage.

It should be further appreciated that if it is not desired to add heat to the interior space, the temperature set point can be set to a level below the actual temperature, that sets the temperature to which the actual temperature in the interior space 25 is allowed to fall prior to sending a TRUE output to the decision block 134.

It is recognized that as heat is delivered to the interior space, the dew point in the interior space rises. If the dew point reaches a level above the maximum level, and thus above the operating dew point band, the control system 20 will not deliver humidity to the interior space. Rather, as described above, humidity will be delivered to the interior space once either 1) the actual dew point falls into the operating dew point band coupled with a determination that either or both of the relative humidity and the dew point are falling in the interior space, or 2) the dew point falls below the operating dew point band regardless of whether the humidity and dew point are rising or falling. It should be appreciated that the methods steps described herein can be set to run constantly, subject to the time delays described herein, so as to perform successive loops of the method 40 while the control system 20 is active. As a result, the dew point in the interior space can be controlled in real time in the manner described above. It is further recognized that the method steps described above provide one example of a control system, and that other method steps are envisioned to maintain the dew pointe within the predetermined operating dew point band.

In some examples, if desired, the control system 20 can include a dehumidifier that is in communication with the controller 30. The controller 30 can activate the dehumidifier to remove humidity from the interior space 25, for instance in instances whereby the dew point reaches a level above than the operating dew point band. This condition could occur, for instance, if the temperature of the room was increased considerably in a relatively short period of time.

It should be noted that the illustrations and discussions of the embodiments shown in the figures are for exemplary purposes only, and should not be construed limiting the disclosure. One skilled in the art will appreciate that the present disclosure contemplates various embodiments. Additionally, it should be understood that the concepts described above with the above-described embodiments may be employed alone or in combination with any of the other embodiments described above. It should be further appreciated that the various alternative embodiments described above with respect to one illustrated embodiment can apply to all embodiments as described herein, unless otherwise indicated.

The invention claimed is:

1. A method for controlling an environment of an interior space, the method comprising the steps of:

determining whether an actual dew point in an interior space is outside an operating dew point band that is defined by a minimum dew point level and a maximum dew point level;

measuring an actual relative humidity in the interior space; and based on the actual dew point being less than the minimum dew point level, adding humidity to the interior space or based on the actual dew point being less than the maximum dew point level and at least one of the actual dew point and the actual relative humidity in the interior space not increasing, adding humidity to the interior space; and when the actual dew point is below the maximum dew point level, adding humidity to the interior space in response to a determination that either or both of the actual dew point and the actual relative humidity is declining.

2. The method of claim 1, wherein the step of adding humidity comprises initially adding humidity at a first rate, and subsequently adding humidity at a second rate greater than the first rate 1) in response to a determination that (i) either or both of the actual dew point and the actual relative humidity has been declining over a predetermined duration, and (ii) either or both of the actual dew point and the actual relative humidity is continuing to fall, and 2) when the actual dew point is no greater than the operating dew point band.

3. The method of claim 1, wherein the step of measuring the actual dew point occurs at a first dew point determination frequency, a step of determining if the actual dew point is declining comprises sampling the actual dew point at a second dew point determination frequency less than the first dew point determination frequency.

4. The method of claim 1, wherein the step of measuring the actual relative humidity occurs at a first humidity determination frequency, a step of determining whether the actual relative humidity is declining comprises sampling the actual relative humidity at a second humidity determination frequency that is less than the first humidity determination frequency.

5. The method of claim 1, further comprising adding humidity to the interior space in response to a determination that the actual dew point is no greater than the minimum dew point level.

6. The method of claim 5, wherein:

the step of adding humidity to the interior space when the actual dew point is below that maximum dew point level and either or both of the actual dew point and the actual relative humidity in the interior space is declining comprises initially adding humidity at a first rate, and subsequently adding humidity at a second rate greater than the first rate if 1) the actual relative humidity continues to fall, and 2) the actual relative humidity remains no greater than the operating dew point band.

7. The method of claim 6, wherein the step of adding humidity to the interior space when the actual dew point is below the minimum dew point level comprises adding humidity at a third rate greater than the second rate.

8. The method of claim 1, further comprising receiving a manual entry of only two of the actual dew point, the actual relative humidity, and an actual temperature of the interior space, and calculating the third rate of the actual dew point, the actual relative humidity, and an actual temperature of the interior space.

9. The method of claim 1, further comprising the step of maintaining the interior space greater than a temperature setpoint.

10. The method of claim 9, wherein the temperature setpoint is in a range from 80 degrees F. to 100 degrees F.

11. The method of claim 1, wherein the step of identifying the operating dew point band comprises receiving an input of at least one of the minimum dew point level and the maximum dew point level.

12. The method of claim 1, wherein the step of identifying the operating dew point band comprises calculating the operating dew point band based on either 1) an input of a desired minimum dew point, or 2) a calculation of a desired minimum dew point based on a user input of a desired minimum temperature and a desired minimum humidity.

13. The method of claim 12, wherein the step of identifying the operating dew point band further comprises calculating the operating dew point band based on a dew point value greater than the minimum dew point.

14. The method of claim 1, wherein the step of adding humidity is performed only after the determination has been ongoing and uninterrupted over a set time delay.

15. The method of claim 1, further comprising the step of adding heat to the interior space when either 1) an actual temperature of the interior space is below a minimum temperature level, or 2) the actual temperature is in a declining condition.

16. A control system comprising a controller configured to perform the steps according to claim 1.

17. A method for controlling an environment of an interior space, the method comprising the steps of:

adding humidity to the interior space when any one or more of the following conditions are met: 1) a humidity level in the interior space is in a declining condition, 2) an actual dew point in the interior space is in a declining condition, and 3) the actual dew point in the interior space is below a minimum dew point level; and wherein the step of adding humidity is performed when the declining conditions have been ongoing and uninterrupted over a set time delay.

18. A method for controlling an environment of an interior space, the method comprising the steps of:

determining whether an actual dew point in an interior space is outside an operating dew point band that is defined by a minimum dew point level and a maximum dew point level;

measuring an actual relative humidity in the interior space; and based on the actual dew point being less than the minimum dew point level, adding humidity to the interior space; and wherein the step of measuring the actual dew point occurs at a first dew point determination frequency, a step of determining if the actual dew point is declining comprises sampling the actual dew point at a second dew point determination frequency less than the first dew point determination frequency.

19. The method of claim 18, wherein:

when the actual dew point is below the maximum dew point level, adding humidity to the interior space in response to a determination that either or both of the actual dew point and the actual relative humidity is declining; or the step of adding humidity comprises initially adding humidity at a first rate, and subsequently adding humidity at a second rate greater than the first rate 1) in response to a determination that (i) either or both of the actual dew point and the actual relative humidity has been declining over a predetermined duration, and (ii) either or both of the actual dew point and the actual relative humidity is continuing to fall, and 2) when the actual dew point is no greater than the operating dew point band; or the step of measuring the actual relative humidity occurs at a first humidity determination frequency, a step of determining whether the actual relative humidity is declining comprises sampling the actual relative humidity at a second humidity determination frequency that is less than the first humidity determination frequency; or the step of identifying the operating dew point band comprises calculating the operating dew point band based on either 1) an input of a desired minimum dew point, or 2) a calculation of a desired minimum dew point based on a user input of a desired minimum temperature and a desired minimum humidity; or further comprising receiving a manual entry of only two of the actual dew point, the actual relative humidity, and an actual temperature of the interior space, and calculating a third rate of the actual dew point, the actual relative humidity, and an actual temperature of the interior space.

* * * * *